United States Patent [19]

Kurahashi et al.

[11] 4,367,464

[45] Jan. 4, 1983

[54] LARGE SCALE DISPLAY PANEL APPARATUS

[75] Inventors: Koichiro Kurahashi, Hyogo; Noriyuki Tomimatsu, Nagasaki, both of Japan

[73] Assignee: Mitsubishi Denki Kabushiki Kaisha, Tokyo, Japan

[21] Appl. No.: 154,262

[22] Filed: May 29, 1980

[30] Foreign Application Priority Data

May 29, 1979 [JP] Japan ..... 54-68642

[51] Int. Cl.[3] ..... G09G 3/00

[52] U.S. Cl. ..... 340/701; 340/703; 340/752; 340/793

[58] Field of Search ..... 340/701, 703, 704, 789, 340/791, 792, 772, 752, 793

[56] References Cited

U.S. PATENT DOCUMENTS

| | | | |
|---|---|---|---|
| 1,595,735 | 8/1926 | Schmierer | 340/752 |
| 2,976,447 | 3/1961 | McNaney | 340/703 |
| 3,262,010 | 7/1966 | Kazan | 340/772 |
| 3,407,331 | 10/1968 | Salgo | 340/701 |
| 3,418,517 | 12/1968 | Corpew | 340/701 |
| 3,595,991 | 7/1971 | Diller | 340/703 |
| 3,899,786 | 8/1975 | Greubel | 340/703 |

*Primary Examiner*—Marshall M. Curtis

*Attorney, Agent, or Firm*—Sughrue, Mion, Zinn, Macpeak and Seas

[57] ABSTRACT

A large scale display device such as a stadium or advertising display in which a plurality of light emitting elements constituted by cathode-ray tubes are arranged in a plane to display color images and characters. Specifically, light emitting elements are constituted by cathode-ray tubes having three primary color light emitting elements. A drive circuit is provided for each color of each of the light emitting element to selectively turn on and off the light emitting element. The drive circuit has brightness adjusting means for adjusting the intensity of light emitted by each light emitting element. A memory circuit is connected to each drive circuit for supplying a binary control signal to the drive circuit to selectively turn on and off the corresponding light emitting element.

5 Claims, 3 Drawing Figures

LARGE SCALE DISPLAY PANEL APPARATUS

BACKGROUND OF THE INVENTION

The present invention relates to a display device in which images and characters are displayed by light emitting elements constituted by cathode-ray tubes.

In a conventional large scale color image display device such as an electric display board for a stadium or an advertising display which may be mounted above the roof or on a side of a building, a number of colored incandescent light bulbs are arranged in a preferred pattern and are selectively turned on and off to display a desired image. Such a large scale color display device suffers from several difficulties.

One of the difficulties is that it is difficult to reproduce certain colors satisfactory. This is due to the fact that the colors provided by a light bulb are determined by the spectrum of the red hot filament of the light bulb. That is, the color of the light emitted by the light bulb filament is red or yellow-orange. In order to obtain the three primary colors, red, green and blue, which are necessary to reproduce a color image, color filters are employed to obtain the three primary color lights. It is considerably difficult to obtain green and blue lights because the light emitted from the light bulb filament contains very little green light component and hardly any blue light component, thereby resulting in reducing of the electric power efficiency.

In the system of selectively turning on and off light bulbs described above, in order to modulate the brightness of each picture element it is necessary to interrupt the application of the constant amplitude current to the filament or to vary the current applied to the filament. If the brightness is attempted to be modulated by controlling the time width in the on-off control of the filament, to increase and decrease the average current, the result is to change the temperature of the filament and hence spectrum of the output lights because of the spectrum of the output light depends on the temperature of the filament. Accordingly, the emission spectrum varies depending on the brightness. That is, the emission spectrum at high brightness is different from that at low brightness (less blue component) which makes it difficult to reproduce an image with the correct hue. Light bulbs used in such applications have a power rating of the order of 12 W. Typically, more than several ten-thousands of light bulbs are used to form a single display device. Accordingly, the conventional display device involves many problems to be solved such as power consumption, heat generated and service life.

SUMMARY OF THE INVENTION

Accordingly, an object of the invention is to provide a color display device which is constituted by monochromatic or multicolor cathode-ray tubes employed as light emitting elements and which has an excellent color reproducibility, low power consumption, and high performance.

More specifically, an object of the invention is to provide a display device using monochromatic or multicolor cathode-ray tubes as light emitting elements as described above in which a memory device for modulating the brightness by controlling a light emitting time period is provided so that the brightness and hue of the displayed image can be accurately controlled and which has a high brightness, low power consumption, and long service life.

The foregoing object and other objects of the invention have been achieved by the provision of a display device which includes light emitting elements constituted by cathode-ray tubes including three-primary-color light emitting units a drive circuit provided for each color of each of the light emitting elements to selectively turn on and off the light emitting units with the drive circuit having brightness adjusting means for adjusting the intensity of light emitted by an activated light emitting unit, and a memory circuit connected to each of the drive circuits for supplying a binary control signal to the drive circuit to selectively turn on and off the light emitting units.

The nature, principle and utility of the invention will become more apparent from the following detailed description when read in conjunction with the accompanying drawings.

DESCRIPTION OF THE PREFERRED EMBODIMENTS

Figure 1:
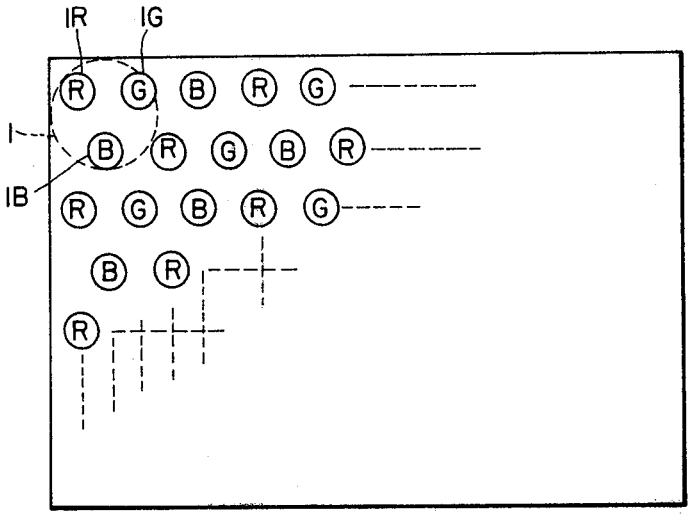
FIG. 1 is a schematic diagram of a preferred embodiment of a display board constructed according to the invention.

A color display device in which the invention is used to advantage is shown in FIG. 1 in which reference numeral 1 designates a single picture element which includes a red cathode-ray tube 1R, a green cathode-ray tube 1G and a blue cathode-ray tube 1B. In other words, one picture element 1 is constituted by three monochromatic small cathode-ray tubes 1R, 1G and 1B which emit red, green and blue light, respectively. A number of picture elements are arranged lengthwise and breadthwise to form a display board.

Figure 2:
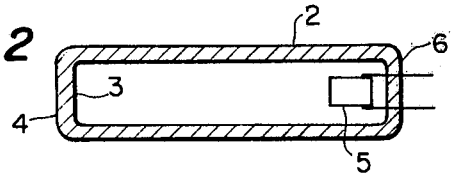
FIG. 2 is a sectional view showing a cathode-ray tube employed in a display device of the invention.

Each of the cathode-ray tubes 1R, 1G and 1B, as shown in FIG. 2 has a vacuum envelope 2 which has a face plate 4 at one end and a electron gun 5 at the other end. The face plate 4 is coated on its inside surface with fluorescent material 3. Operating voltages are supplied to the various elements of the electron gun 5 as required. The vacuum envelope 2 is sealed by a stem 6. The fluorescent material 3 is a monochromatic fluorescent material which emits red, green or blue light as selected. The electron gun 5 produces a flood of electrons (not a focused electron beam) which is applied to the surface coated with the fluorescent material 3 which causes the fluorescent material 3 to emit light.

In the color display device of the invention, the provision of light intensity modulation is achieved both by adjusting the peak intensity of electrons emitted from the electron guns 5 and by adjusting the time period (on-time period) during which the electron current is applied to the fluorescent material. In each of the cathode-ray tubes 1R, 1G and 1B, the time response of an optical image is determined by the afterglow characteristics of the fluorescent material employed. In general, the afterglow time of fluorescent material employed in a display device of this type is 1 ms or less. Therefore, even if the image is switched at a frequency of 60 Hz or higher, no problem occurs. Furthermore, as the electron flow can be easily modulated, half-tones in brightness can be accurately reproduced. Since the hue of the displayed image is determined by the ratio of the brightness of the three primary colors, the hue of the displayed image is also accurately reproduced.

It is known in the art that, about 1,000 foot-lamberts is required for the brightness of green, for instance, in a display device of this type. Under this condition, the amount of power consumption per cathode ray tube is only about 1.1 W. With this construction not only images in motion can be displayed but also natural colors including half-tones can be reproduced. In addition, the power consumption is greatly reduced.

Figure 3:
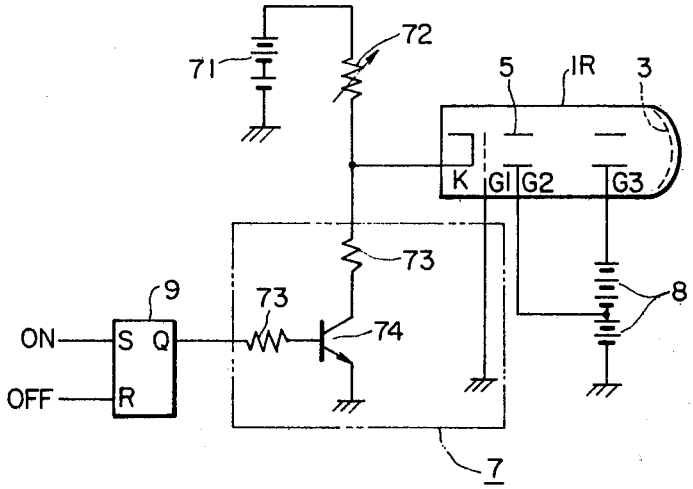
FIG. 3 is a circuit diagram showing a display unit of a display device of the invention.

FIG. 3 shows a light emitting unit which emits one of the three primary colors for one of the picture element. By way of example, the light emitting unit will be described with reference to a red cathode-ray tube.

In FIG. 3, reference character 1R designates a red cathode-ray tube; 5 the electron gun of the cathode-ray tube having a cathode K and grids G1, G2 and G3; 7 a drive circuit for the cathode-ray tube 1R with the drive circuit 7 including a power source 71, a brightness adjusting variable resistor 72, resistors 73, and transistor 74; 8 a high voltage source; and 9 a memory circuit. The memory circuit 9 preferably is constituted by a flip-flop which supplies a binary (on and off) control signal to the drive circuit 7 to turn on and off the cathode-ray tube 1R. More specifically, one of a control signal to turn on the cathode-ray tube 1R and a control signal to turn off the cathode-ray tube 1R, hereinafter referred to as "an ON-signal" and "an OFF-signal", respectively, is stored in the flip-flop. When the ON-signal is stored in the flip-flop, the transistor 74 is rendered conductive by the output voltage of the flip-flop. On the other hand, when the OFF-signal is stored in the flip-flop, the transistor 74 is rendered non-conductive by the output voltage of the flip-flop. When the transistor 74 is rendered conductive, the potential at the cathode K of the cathode-ray tube 1R is reduced as a result of which the cathode-ray tube 1R emits light. On the other hand, when the transistor 74 is rendered non-conductive, the potential at the cathode is increased and the emission of light from the cathode-ray tube 1R is suspended.

The light emitting unit thus constructed has two states. That is, "on" and "off" states are provided for each of the three primary colors red, green and blue. A number of light emitting units and elements are arranged as shown in FIG. 1 to form the display device.

An image having half-tones can be displayed on the display device by controlling each unit in such a manner that the time period during which each unit is in the "on" state is proportional to the magnitude of an image signal applied thereto. For an image having no half-tone, the light emitting units should be maintained in the "on" state throughout the entire display period.

As the response time of each cathode-ray tube is much shorter than the display period, the intensity of light emitted by the cathode-ray tube is substantially proportional to the time period during which it is turned on. The absolute value of the light intensity is determined by the drive voltage amplitude of the cathode K. The variable resistor 72 in FIG. 3 thus determines the peak value of the light intensity of the cathode-ray tube when it is in the "on" state. That is, the variable resistor 72 is used to adjust the current flowing in the cathode of the cathode-ray tube while it is in the "on" state thereby adjusting the peak intensity of light emitted. With this control section provided for each unit, not only the white balance of red, green and blue can be adjusted but also differences in characteristics among cathode-ray tubes can be corrected. Since the intensity of light emitted is sufficiently precisely proportional to the time period during which the cathode-ray tube is in the "on" state, and because the spectrum of the output lights does not depend on the intensity of light emitted, the hue is unaffected by the brightness level after the correction.

In the above-described embodiment, a flip-flop is employed as the memory circuit 9. However, the flip-flop may be replaced by any device having a memory function. Furthermore, the cathode-ray tube drive circuit may be modified as the case may be. The brightness in the preferred embodiment is adjusted by changing the cathode current with the variable resistor. However, this technique may be replaced by one in which the voltage at the grid G1 is varied at this has the same effect.

Further in the above-described embodiment, each cathode-ray tube emits a single color light, red, green, or blue. However, the cathode-ray tube may be so modified that it has three red, green and blue light emitting elements and each element is provided with its own drive circuit. One high voltage source 8 may be provided for each cathode-ray tube or, alternatively, one high voltage source 8 may be provided in common for several light emitting units.

As is clear from the above description, the display device according to the invention utilizes effectively the features of a cathode-ray tube in that the cathode-ray tube has a short response time and high light emitting efficiency. Further, as each unit has an on-off operation memory function according to the invention, an image having half-tones can be readily displayed by time period control. Therefore, the display device of the invention is advantageous in practical use in that even if the brightness is changed, the hue remains unchanged and in that the device has a high brightness and low power consumption. In addition, the display device of the invention is meritorious in that maintenance is simple because very little heat is generated and its service life is therefore long.

What is claimed is:

1. A large scale color display panel capable of displaying an image containing half tones and of varying intensity, comprising:

a plurality of light emitting elements, each of said light emitting elements being capable of emitting light in a selected combination of three primary colors, each of said light emitting elements comprising three cathode-ray tubes, each cathode-ray tube comprising at least one fluorescent screen for emitting light of one of said primary colors from substantially an entire front surface thereof and an electron gun for producing an unfocused flood of electrons directed toward said fluorescent screen;

a plurality of drive circuits, one of said drive circuits being provided for each said electron gun for turning on and off said electron gun with an on-to-off time ratio determined in accordance with an intensity of light to be emitted by the cathode-ray tube of which said electron gun forms a part, and hence a hue of light to be emitted from the light emitting element of which said cathode-ray tube forms a part;

a plurality of memory means, one of said memory means being provided for each said drive circuit for storing a binary control signal representing and on/off state of a corresponding one of said electron guns; and brightness adjusting means coupled to each of said drive circuits for setting a brightness level of light to be emitted by controlling a magnitude of drive of said electron guns.

2. The display device as claimed in claim 1 in which said memory circuit means comprises a flip-flop circuit.

3. The display device as claimed in claim 1 wherein each of said drive circuits comprises a transistor which is selectively rendered conductive and non-conductive in response to said control signal of said memory circuit to control a cathode voltage of said cathode-ray tube.

4. The display device as claimed in claim 1 wherein each of said drive circuits comprises a transistor which is selectively rendered conductive and non-conductive in response to said control signal of said memory circuit to control a cathode voltage of said cathode-ray tube.

5. The display device as claimed in claims 3 or 4 wherein said brightness adjusting means comprises a variable resistor for controlling a cathode current of said cathode-ray tube, said brightness adjusting means being connected in series with a power source and said transistor.

* * * * *